US007732111B2

(12) United States Patent
Wu et al.

(10) Patent No.: US 7,732,111 B2
(45) Date of Patent: Jun. 8, 2010

(54) PHOTOCONDUCTORS CONTAINING HALOGENATED BINDERS AND AMINOSILANES IN HOLE BLOCKING LAYER

(75) Inventors: Jin Wu, Webster, NY (US); Satchidanand Mishra, Webster, NY (US); Geoffrey M T. Foley, Fairport, NY (US); Anthony M. Horgan, Pittsford, NY (US); Yonn K. Rasmussen, Pittsford, NY (US); Michael A. Morgan, Fairport, NY (US); Kathleen M. Carmichael, Williamson, NY (US); Edward F. Grabowski, Webster, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 695 days.

(21) Appl. No.: 11/714,614

(22) Filed: Mar. 6, 2007

(65) Prior Publication Data

US 2008/0220349 A1 Sep. 11, 2008

(51) Int. Cl.
*G03G 5/14* (2006.01)

(52) U.S. Cl. ..... 430/58.8; 430/64; 430/65; 430/131

(58) Field of Classification Search ..... 430/64, 430/65, 59.4, 59.5, 58.8, 58.75, 970, 131, 430/133

See application file for complete search history.

(56) References Cited

U.S. PATENT DOCUMENTS

| | | | | |
|---|---|---|---|---|
| 4,273,846 | A * | 6/1981 | Pai et al. | 430/58.75 |
| 4,464,450 | A | 8/1984 | Teuscher | |
| 4,921,769 | A | 5/1990 | Yuh et al. | |
| 4,921,773 | A | 5/1990 | Melnyk et al. | |
| 5,473,064 | A * | 12/1995 | Mayo et al. | 540/141 |
| 5,635,324 | A * | 6/1997 | Rasmussen et al. | 430/58.8 |
| 5,958,638 | A * | 9/1999 | Katayama et al. | 430/65 |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 6,913,863 | B2 | 7/2005 | Wu et al. | |
| 7,037,631 | B2 | 5/2006 | Wu et al. | |
| 7,419,752 | B2 * | 9/2008 | Wu et al. | 430/59.6 |
| 2005/0058919 | A1 * | 3/2005 | Tong et al. | 430/64 |

FOREIGN PATENT DOCUMENTS

| | | | |
|---|---|---|---|
| DE | 2064580 | A * | 7/1972 |
| GB | 1310600 | A * | 3/1973 |

OTHER PUBLICATIONS

Diamond, Arthur S & David Weiss (eds.) Handbook of Imaging Materials, 2nd ed.. New York: Marcel-Dekker, Inc. (Nov. 2001) pp. 401-403.*

Product Literature for IXAN PV-910 (May 2005).*

Product Literature for IXAN SGA-1 (Jul. 2003).*

Jin Wu et al., U.S. Appl. No. 11/593,658 on Photoconductors Containing Halogenated Binders, filed Nov. 7, 2006.

Jin Wu et al., U.S. Appl. No. 11/256,811 on Imaging Member Having Barrier Polymer Resins, filed Oct. 24, 2005.

Jin Wu et al., U.S. Appl. No. 11/605,523 on Polyhedral Oligomeric Silsesquioxane Thiophosphate Containing Photoconductors, filed Nov. 28, 2006.

John F. Yanus et al., U.S. Appl. No. 11/593,875 on Silanol Containing Overcoated Photoconductors, filed Nov. 7, 2006.

John F. Yanus et al., U.S. Appl. No. 11/593,657 on Overcoated Photoconductors with Thiophosphate Containing Charge Transport Layers, filed Nov. 7, 2006.

John F. Yanus et al., U.S. Appl. No. 11/593,656 on Silanol Containing Charge Transport Overcoated Photoconductors, filed Nov. 7, 2006.

John F. Yanus et al., U.S. Appl. No. 11/593,662 on Overcoated Photoconductors with Thiophosphate Containing Photogenerating Layer, filed Nov. 7, 2006.

Jin Wu et al., U.S. Appl. No. 11/605,522 on Thiophosphate Containing Photoconductors, filed Nov. 28, 2006.

* cited by examiner

*Primary Examiner*—Christopher RoDee
(74) *Attorney, Agent, or Firm*—E. O. Palazzo

(57) ABSTRACT

A photoconductor containing a supporting substrate; an undercoat layer comprised of a mixture of an aminosilane and a halogenated polymer; a photogenerating layer; and at least one charge transport layer.

28 Claims, No Drawings

PHOTOCONDUCTORS CONTAINING HALOGENATED BINDERS AND AMINOSILANES IN HOLE BLOCKING LAYER

CROSS REFERENCE TO RELATED APPLICATIONS

In U.S. application Ser. No. 11/593,658, U.S. Publication No. 20080107982, filed Nov. 7, 2006, the disclosure of which is totally incorporated herein by reference, there is illustrated a photoconductor comprising an optional supporting substrate, a photogenerating layer, and at least one charge transport layer, and wherein the photogenerating layer is comprised of at least one photogenerating pigment, and a resin binder that is substantially insoluble in an alkylene halide and wherein the binder is for example, a copolymer of vinylidene chloride, chlorinated vinyl chloride, and chlorinated vinylidene chloride with vinylidene fluoride, tetrafluoroethylene, trifluorochloroethylene, and hexafluoropropylene.

In U.S. application Ser. No. 11/256,811, now U.S. Pat. No. 7,419,752, filed Oct. 24, 2005, the disclosure of which is totally incorporated herein by reference, there is illustrated an electrophotographic imaging member, comprising:

a substrate;

an undercoat layer formed on the substrate; and at least one imaging layer formed on the undercoat layer, wherein the imaging layer comprises a barrier polymer having an oxygen transmission rate of from about 5 to about 250 $cm^3 \mu m/m^2$ dbar, a water vapor transmission rate of from about 5 to 100 $g\mu m/m^2 d$, and a high dielectric constant of from about 5 to about 25.

U.S. application Ser. No. 11/605,523, U.S. Publication No. 20080124640, filed Nov. 28, 2006, the disclosure of which is totally incorporated herein by reference, on Polyhedral Oligomeric Silsesquioxane Thiophosphate Containing Photoconductors by Jin Wu et al.

U.S. application Ser. No. 11/593,875, U.S. Publication No. 20080107985, filed Nov. 7, 2006, the disclosure of which is totally incorporated herein by reference, on Silanol Containing Overcoated Photoconductors by John F. Yanus et al.

U.S. application Ser. No. 11/593,657, U.S. Publication No. 20080107984, filed Nov. 7, 2006, the disclosure of which is totally incorporated herein by reference, on Overcoated Photoconductors with Thiophosphate Containing Charge Transport Layers by John F. Yanus et al.

U.S. application Ser. No. 11/593,656, U.S. Publication No. 20080107979, filed Nov. 7, 2006, the disclosure of which is totally incorporated herein by reference, on Silanol Containing Charge Transport Overcoated Photoconductors by John F. Yanus et al.

U.S. application Ser. No. 11/593,662, U.S. Publication No. 20080107983, filed Nov. 7, 2006, the disclosure of which is totally incorporated herein by reference, on Overcoated Photoconductors With Thiophosphate containing Photogenerating Layer by John F. Yanus.

U.S. application Ser. No. 11/605,522, U.S. Publication No. 20080124639, filed Nov. 28, 2006, the disclosure of which is totally incorporated herein by reference, on Thiophosphate Containing Photoconductors by Jin Wu et al.

A number of the components of the above cross-referenced patent applications, such as the supporting substrates, the photogenerating layer pigments and binders, the charge transport layer molecules and binders, the adhesive layer materials, and the like may be selected for the photoconductors of the present disclosure in embodiments thereof.

BACKGROUND

This disclosure is generally directed to layered imaging members, photoreceptors, photoconductors, and the like. More specifically, the present disclosure is directed to rigid or multilayered flexible, belt imaging members, or devices comprised of an optional supporting medium like a substrate, an undercoat or hole blocking layer usually situated between the substrate and the photogenerating layer, a photogenerating layer, and at least one charge transport layer, wherein at least one is from 1 to about 5, from 1 to about 3, 2, one, and the like, such as a first charge transport layer and a second charge transport layer, an optional adhesive layer, and an optional overcoating layer, and wherein at least one of the charge transport layers contains at least one charge transport component, and a polymer or resin binder, and where the resin binder selected for the undercoat layer is one that is substantially insoluble in a number of solvents like methylene chloride, examples of these binders being illustrated in copending U.S. application Ser. No. 11/593,658, the disclosure of which is totally incorporated herein by reference, and which undercoat layer also includes an aminosilane, especially a hydrolyzed aminosilane, which primarily functions as an electroconducting component or species. In embodiments, there is disclosed a photoconductor where the chlorinated polymers of the undercoat layer are substantially insoluble in an alkylene halide, especially methylene chloride. Insoluble or substantially insoluble refers, for example, to an insolubility percentage for the halogenated, and more specifically, chlorinated polymer in methylene chloride of from about 90 to about 100 percent, and more specifically, from about 95 to about 99 percent.

In embodiments there are disclosed low charge deficient spots (CDS) photoconductors with novel micron thick blocking layers of chlorinated polymeric resins as the binder and a hydrolyzed aminosilane as the electroconducting species since it is believed that the $CH_2Cl_2$ insoluble binders prevent or minimize the migration of hole transport molecules from upper charge transport layer into lower layers, and then into the undercoat or ground plane layer. Examples of chlorinated homopolymers include polyvinylidene chloride, chlorinated polyvinyl chloride, and chlorinated polyvinylidene chloride. Examples of chlorinated copolymers include copolymers of vinylidene chloride, chlorinated vinyl chloride, and chlorinated vinylidene chloride with vinylidene fluoride, tetrafluoroethylene, trifluorochloroethylene, hexafluoropropylene, and the like.

A number of advantages are associated with the disclosed photoconductors, such as for example the formation of minimal charge deficient spots (CDS) which result in undesirable printing defects, and where the spots can be generated from the photogenerating layer, and the charge transport layer or layers; minimization or prevention of the migration of hole transport molecules or components from one charge transport layer to another layer in the photoconductor, such as the photogenerating layer and the charge transport layer, and more specifically, from the top or upper charge transport layer into lower layers of the photoconductor, such as lower charge transport layers and the lower photogenerating layer thereby permitting less undesirable charge deficient spots in the developed image generated. Moreover, the chlorinated polymers selected possess a high impermeability to gases and moisture, for example, the oxygen transmission rates (23° C. and 0 percent RH) of the polymers vary from about 5 to about 250 $cm^3 \mu m/m^2$ dbar, and the water vapor transmission rates (38° C. and 90 percent RH) of the polymers vary from about 5 to about 100 grams $\mu m/m^2 d$ permitting environmentally stable photoinduced discharge. Furthermore, these polymers have high dielectric constants of usually at least about 5, from about 7 to about 25, or from about 8 to about 18 (throughout "from about" includes all values in between the values recited). The photoreceptors illustrated herein, in embodiments, have extended lifetimes; possess excellent, and in a number of instances low V, (residual potential); and allow the substantial prevention of $V_r$ cycle up when appropriate; high sensitivity; low acceptable image ghosting characteristics; and desirable toner cleanability.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, or hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoconductors have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer, and which layers can include a number of resin binders. Examples of photogenerating layer components disclosed in the '990 patent include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound, and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example Example I of U.S. Pat. No. 6,156,468, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above-recited patents may be selected for the present disclosure in embodiments thereof. More specifically, a number of the components and amounts thereof of the above patents, such as the supporting substrates, resin binders for the charge transport layer, photogenerating layer components like hydroxygallium phthalocyanines (OHGaPc), antioxidants, charge transport components, hole blocking layer components, adhesive layers, and the like, may be selected for the members of the present disclosure in embodiments thereof.

SUMMARY

Disclosed are imaging members with many of the advantages illustrated herein, such as the minimal generation of charge deficient spots, extended lifetimes of service of, for example, in excess of about 2,500,000 imaging cycles; excellent electronic characteristics; stable electrical properties; low image ghosting; resistance to charge transport layer cracking upon exposure to the vapor of certain solvents; consistent $V_r$ (residual potential) that is substantially flat or no change over a number of imaging cycles as illustrated by the generation of known PIDC (Photo-Induced Discharge Curve), and the like.

Further disclosed are layered flexible photoresponsive imaging members with sensitivity to visible light.

Moreover, disclosed are layered belt photoresponsive or photoconductive imaging members with mechanically robust and solvent resistant charge transport layers.

Additionally, disclosed are flexible imaging members with chlorinated polymers and aminosilanes containing hole blocking layers permitting, for example, a hole blocking layer with excellent efficient electron transport which usually results in a desirable photoconductor low residual potential $V_{low}$.

EMBODIMENTS

Aspects of the present disclosure relate to an imaging member comprising an optional supporting substrate, a hole blocking layer thereover, and which layer is comprised of an aminosilane and binder substantially insoluble in methylene chloride; a photogenerating layer comprised of a photogenerating component optionally dispersed in a resin or polymer binder, and at least one charge transport layer, such as from 1 to about 7 layers, from 1 to about 5 layers, from 1 to about 3 layers, 2 layers, or 1 layer; a flexible photoconductor comprising in sequence a substrate, a photogenerating layer, and at least one charge transport layer comprised of at least one charge transport component comprised of hole transport molecules and a resin binder, and a hole blocking layer comprised of an aminosilane and a halogenated, such as a chlorinated, polymeric resin that is insoluble or substantially insoluble in methylene chloride, and a number of other similar solvents; a photoconductive imaging member comprised of a supporting substrate, an aminosilane and a chlorinated polymeric containing hole blocking layer, a photogenerating layer, a charge transport layer, and a top overcoating second charge transport layer; a photoconductive member with a photogenerating layer of a thickness of from about 0.1 to about 10 microns, at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, and thereover a hole blocking layer comprised of a number of aminosilanes and a halogenated polymer; a photogenerating layer comprised of a photogenerating pigment dispersed in a polymeric binder, and a charge transport layer or layers, and thereover an overcoating charge transport layer, and where the transport layer is of a thickness of from about 40 to about 75 microns; a member wherein the photogenerating layer contains a binder like a polycarbonate, and dispersed therein a photogenerating pigment present in an amount of from about 5 to about 95 weight percent; a member wherein the thickness of the photogenerating layer is from about 0.1 to about 4 microns; a member wherein the halogenated hole blocking layer polymer binder is present in an amount of from about 0.1 to about 90, from 1 to about 50, from 2 to about 25, from 5 to about 10 percent by weight, and wherein the total of all blocking layer components is about 100 percent; a member wherein the photogenerating component is a hydroxygallium phthalocyanine that absorbs light of a wavelength of from about 370 to about 950 nanometers; an imaging member or photoconductor wherein the supporting substrate is comprised of a conductive substrate comprised of a metal; an imaging member wherein the conductive substrate is aluminum, aluminized polyethylene terephthalate or titanized polyethylene terephthalate; a photoconductor or an imaging member wherein the photogenerating pigment is a metal free phthalocyanine; an imaging member wherein each or at least one of the charge transport layers comprises

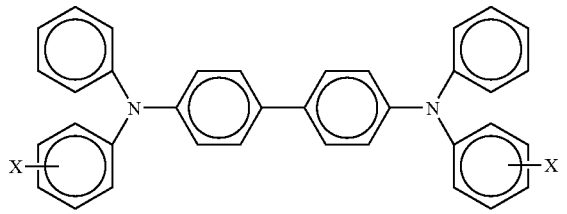

wherein X is selected from the group consisting of a suitable hydrocarbon like alkyl, alkoxy, aryl and substituted derivatives thereof; halogen, and mixtures thereof, or wherein X can be included on the four terminating rings; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

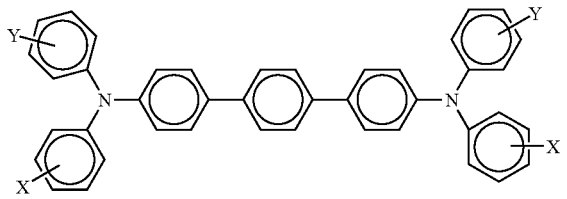

wherein X and Y are independently alkyl, alkoxy, aryl, a halogen, or mixtures thereof; an imaging member wherein for the above terphenyl amine alkyl and alkoxy each contains from about 1 to about 12 carbon atoms; an imaging member wherein alkyl contains from about 1 to about 5 carbon atoms; an imaging member wherein the photogenerating pigment present in the photogenerating layer is comprised of chlorogallium phthalocyanine, titanyl phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta±0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member, developing the latent image, and transferring the developed electrostatic image to a suitable substrate; a method of imaging wherein the imaging member is exposed to light of a wavelength of from about 370 to about 950 nanometers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 0.05 weight percent to about 95 weight percent, and wherein the photogenerating pigment is dispersed in from about 96 weight percent to about 5 weight percent of polymer binder, and where the hole blocking layer contains a chlorinated polymer binder; a member wherein the thickness of the photogenerating layer is from about 0.2 to about 12 microns; an imaging member wherein the charge transport layer resinous binder is selected from the group consisting of polyesters, polyvinyl butyrals, polycarbonates, polyarylates, copolymers of polycarbonates and polysiloxanes, polystyrene-b-polyvinyl pyridine, and polyvinyl formals; an imaging member wherein the photogenerating component is Type V hydroxygallium phthalocyanine, titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, an imaging member wherein the alkylene halide contains from 1 to about 12 carbon atoms, and halide is chloride, bromide, iodide, or fluoride; an imaging member wherein the photogenerating layer contains an alkoxygallium phthalocyanine; a photoconductive imaging member with an aminosilane and chlorinated polymer containing blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a hole blocking or undercoat layer as illustrated herein, a photogenerating layer, a hole transport layer, and a top overcoating layer in contact with the hole transport layer, or in embodiments in contact with the photogenerating layer, and in embodiments wherein a plurality of charge transport layers are selected, such as for example, from 2 to about 10, and more specifically 2; and a photoconductive imaging member comprised in sequence of a supporting substrate, a hole blocking layer comprised of a mixture of an aminosilane and chlorinated polymer binder, a photogenerating layer comprised of a photogenerating pigment, and a first, second, or third charge transport layer; a photoconductor wherein the hole blocking layer binder is at least one of a homopolymer of polyvinylidene chloride, a chlorinated polyvinyl chloride, and a chlorinated polyvinylidene chloride, and the alkylene contains from 1 to about 12 carbon atoms; a photoconductor wherein the binder is a copolymer of vinylidene chloride, chlorinated vinyl chloride, and chlorinated vinylidene chloride with vinylidene fluoride, tetrafluoroethylene, trifluorochloroethylene, and hexafluoropropylene, respectively; and a photoconductor comprising in sequence a substrate, a hole blocking or undercoat layer, a photogenerating layer, and at least one charge transport layer comprised of at least one charge transport component, and a resin binder; and wherein the hole blocking layer is comprised of at least one of a chlorinated polymer binder of a homopolymer of polyvinylidene chloride, a chlorinated polyvinyl chloride, and a chlorinated polyvinylidene chloride, and a copolymer of vinylidene chloride, chlorinated vinyl chloride, and chlorinated vinylidene chloride with vinylidene fluoride, tetrafluoroethylene, trifluorochloroethylene, and hexafluoropropylene, respectively, and an aminosilane.

Examples of homopolymers selected as a polymer binder for the hole blocking layer include polyvinylidene chlorides, chlorinated polyvinyl chlorides, and chlorinated polyvinylidene chlorides. Examples of chlorinated copolymers that can be selected as the binder include copolymers of vinylidene chloride, chlorinated vinyl chloride, and chlorinated vinylidene chloride with vinylidene fluoride, tetrafluoroethylene, trifluorochloroethylene, hexafluoropropylene, and the like inclusive of the corresponding bromides, fluorides, iodides, and inclusive of IXAN™ PNE 275, PNE 613, PNE 61, (IXAN™ PNE 61, believed to be a homopolymer of vinylidene chloride commercially available from Solvay Chemicals, and which homopolymer possesses a high dielectric constant of ∈>10 at 20° C./1 kHz, and high impermeable characteristics to gases and moisture), SGA-1 and XNE 288, which are homopolymers of vinylidene chloride, all commercially available from Solvay, Brussels, Belgium.

A number of the polymers selected for the hole blocking layer can be represented by the following formulas/structures

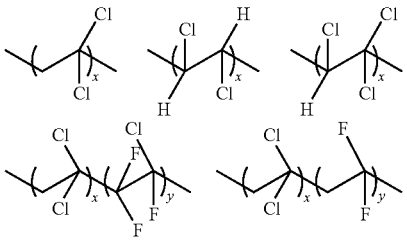

-continued

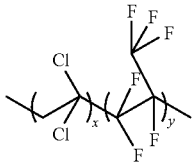

wherein x and y represent the number of repeating units such as from about 10 to about 5,000, from about 100 to about 4,000, and from about 500 to about 3,000.

Aminosilane examples include

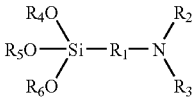

wherein $R_1$ is an alkylene group containing, for example, from 1 to about 25 carbon atoms, $R_2$ and $R_3$ are independently selected from the group consisting of at least one of hydrogen, alkyl containing, for example, 1 to about 5, and more specifically, about 3 carbon atoms; an aryl with, for example, from about 6 to about 36 carbon atoms, such as a phenyl group and a poly(ethylene amino) group; and $R_4$, $R_5$, and $R_6$ are independently selected from an alkyl group containing, for example, 1 to about 6 and more specifically, about 4 carbon atoms.

The aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilylpropyldiethylene triamine, and the like, and mixtures thereof. Specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

Various amounts of the halogenated binder, which binder can in embodiments also function as an adhesion component or adhesion layer, can be included in the hole blocking layer, such as, for example, from about 0.1 to about 90, from about 1 to about 50, from about 2 to about 25, with the amount of aminosilane being, for example, from about 10 to about 99.9 weight percent or from about 50 to about 95 weight percent; and where the total of the two components is about equal to 100 percent. The hole blocking layer thickness can be of any suitable value, such as for example, from about 0.05 to about 10 microns, from about 0.1 to about 5 microns, from about 0.5 to about 2 microns.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer halogenated polymer binders in embodiments possess a high impermeability to gases and moisture, for example the oxygen transmission rates (23° C. and 0 percent RH) vary from about 5 to about 250 $cm^3$ μm/$m^2$ dbar; the water vapor transmission rates (38° C. and 90 percent RH) vary from about 5 to about 100 grams μm/$m^2$d. Furthermore, the binder polymers in embodiments are of a high dielectric constant of usually, for example, at least about 5, from about 7 to about 30, or from about 8 to about 18. Polycarbonate, a known binder, possesses an oxygen transmission rate of above 2,000 $cm^3$ μm/$m^2$ dbar, a water vapor transmission rate of above 1,500 grams μm/$m^2$d, and a dielectric constant of about 3.

The thickness of the photoconductor substrate layer depends on a number of factors, including economical considerations, electrical characteristics, and the like, thus this layer may be of a thickness of, for example, over 3,000 microns, such as from about 1,000 to about 3,000 microns, from about 1,000 to about 2,000 microns, from about 500 to about 1,200 microns, or from about 300 to about 700 microns, or of a minimum thickness. In embodiments, the thickness of this layer is from about 75 microns to about 300 microns, or from about 100 to about 150 microns.

The substrate may be opaque or substantially transparent and may comprise any suitable material that functions as a supporting layer for the hole blocking, adhesive, photogenerating, and charge transport layers, and which substrate should possess the appropriate mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum photoconductor, this layer may be of a substantial thickness of, for example, up to many centimeters or of a minimum thickness of less than a millimeter. Similarly, a flexible belt may be of a substantial thickness of, for example, about 250 micrometers, or of a minimum thickness of equal to or less than about 50 micrometers, such as from about 5 to about 45, from about 10 to about 40, from about 1 to about 25, or from about 3 to about 45 micrometers. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer in embodiments is comprised of, for example, about 60 weight percent of Type V hydroxygallium phthalocyanine or chlorogallium phthalocyanine, and about 40 weight percent of a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 4 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

Photogenerating layer examples may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional technique such as oven drying, infrared radiation drying, air drying, and the like.

The coating of the photogenerating layer in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.2 to about 5 microns can be applied to or deposited on the substrate, on other surfaces in between the substrate, and the charge transport layer, and the like.

For the deposition of the photogenerating layer, it is desirable to select a coating solvent that may not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of suitable known charge transport components, molecules, or compounds can be selected for the charge transport layer, which layer is generally of a thickness of from about 5 microns to about 90 microns, and more specifically, of a thickness of from about 10 microns to about 40 microns, such as aryl amines of the following formula/structure

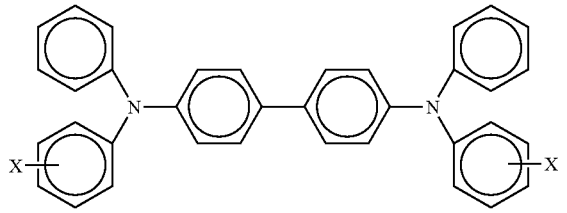

wherein X, which X may also be contained on each of the four terminating rings, is a suitable hydrocarbon such as alkyl, alkoxy, aryl, derivatives thereof, or mixtures thereof; and a halogen, or mixtures of the hydrocarbon and halogen, and especially those substituents selected from the group consisting of Cl and $CH_3$; and molecules of the following formula

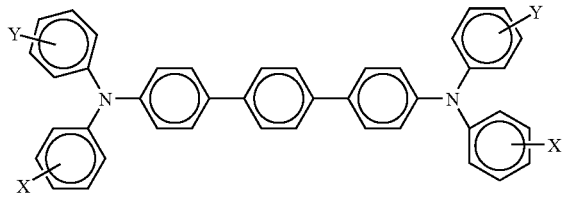

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines present in an amount of from about 20 to about 90 weight percent include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, and present in an amount of from about 40 to about 90 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the charge transport layer and an overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure can in embodiments transport holes during imaging and should not have too high a free carrier concentration. Free carrier concentration in the overcoat increases the dark decay. Examples of overcoatings such as PASCO are illustrated in copending applications, the disclosures of which are totally incorporated herein by reference.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA™ STAB AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO Co., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the layers, specifically disclosed herein are not intended to be exhaustive. Thus, a number of suitable components, polymers, formulas, structures, and R groups or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 12 carbon atoms, includes 1, 2, 3, 4, 5, 6, 7, 8, 9, 10, 11, and 12, up to 25, or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated.

Comparative Example 1

An imaging member or photoconductor was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in the forced air dryer of the coater. The resulting hole blocking layer had a dry thickness of 500 Angstroms. An adhesive layer was then prepared by applying a wet coating over the blocking layer, using a gravure applicator, and which adhesive contained 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or POLYCARBONATE PCZ™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. The resulting slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer, and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting imaging member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

Example I

An imaging member or photoconductor was prepared by repeating the process of Comparative Example 1 except that the hole blocking layer solution was prepared by (1) dissolving a polyvinylidene chloride homopolymer, IXAN PNE™ 613, available from Solvay, Brussels, Belgium (1 gram) in 12 grams of tetrahydrofuran and 8 grams of toluene; (2) introducing 9 grams of the above aminosilane, 3-aminopropyl triethoxysilane (γ-APS) into the polymer of (1) and mixing for at least 3 hours; and (3) adding 0.09 gram of acetic acid into the formed mixture and mixing for at least 2 hours. Thereafter, the resulting solution was applied to the above substrate with a Bird applicator to form a blocking layer, which after drying at 120° C. for 1 minute had a dry thickness of about 0.5 μm.

Electrical Property Testing

The above prepared two photoconductors were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves. The scanner is equipped with a scorotron set to a constant voltage charging at various surface potentials. The photoconductors were tested at surface potentials of 500 with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.).

Compared with the imaging member of Comparative Example 1, the disclosed imaging member of Example I with the hole blocking layer of polyvinylidene chloride as the binder and the above aminosilane exhibited almost identical PIDCs with each excellent dark decay.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member. The method of U.S. Pat. No. 5,703,487, the disclosure of which is totally incorporated herein by reference, designated as field-induced dark decay (FIDD), involves measuring either the differential increase in charge over and above the capacitive value or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

U.S. Pat. Nos. 6,008,653 and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, a floating fixture which maintains a substantially constant distance between the probe and the imaging surface. A constant voltage charge is applied to the imaging surface prior to relative movement of the probe and the imaging surface past each other, and the probe is synchronously biased to within about ±300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots. Both the photoconductors of Comparative Example 1 and Example I were measured for CDS counts using the above-described FPS technique, and the results follow in Table 1.

TABLE 1

| | CDS (counts/cm$^2$) |
|---|---|
| Comparative Example 1 | 34.4 |
| Example I | 10.3 |

The above CDS data demonstrated that with the chlorinated polymer binder CDS was minimal, and more specifically, improved by 70 percent as compared to the Comparative Example 1 control of 34.4, which 34.4 could be caused, it is believed, by the migration of hole transport molecules from the top layers into lower layers, and prevented or minimized the above Example I photoconductor containing the chlorinated polymer polyvinylidene chloride being insoluble in methylene chloride.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a hole blocking layer, a photogenerating layer, and at least one charge transport layer, and wherein said hole blocking layer is comprised of a resin binder that is substantially insoluble in an alkylene halide, and an aminosilane, and wherein said binder is a homopolymer of vinylidene chloride.

2. A photoconductor in accordance with claim 1 wherein said substrate is present, wherein said alkylene halide is methylene chloride, and wherein said substantially insoluble is from about 90 to about 100 percent insoluble in said methylene chloride.

3. A photoconductor in accordance with claim 1 wherein said alkylene halide is methylene chloride, said at least one is one or two, and wherein said substantially insoluble is from about 92 to about 99 percent.

4. A photoconductor in accordance with claim 1 wherein said binder possesses a dielectric constant of from about 5 to about 25.

5. A photoconductor in accordance with claim 1 wherein said binder is present in an amount of from about 0.1 to about 90 weight percent, said aminosilane is present in an amount of from about 10 to about 99.9 weight percent, and wherein the total of said binder and said aminosilane is about 100 weight percent.

6. A photoconductor in accordance with claim 1 wherein said binder is present in an amount of from about 1 to about 50 weight percent, said aminosilane is present in an amount of from about 50 to about 99 weight percent, and wherein the total of said binder and said aminosilane is about 100 weight percent.

7. A photoconductor in accordance with claim 1 wherein said charge transport layer is comprised of aryl amine molecules, and which aryl amines are of the formula

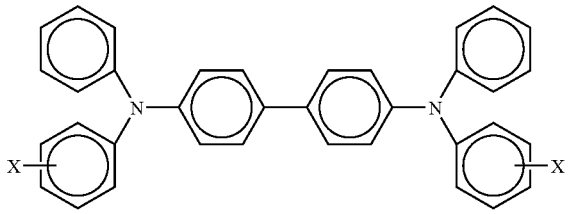

wherein X is selected from the group consisting of at least one of alkyl, alkoxy, aryl, and halogen.

8. A photoconductor in accordance with claim 7 wherein alkyl and alkoxy each contain from about 1 to about 10 carbon atoms; and said alkylene halide is methylene chloride.

9. A photoconductor in accordance with claim 7 wherein said aryl amine is N,N'-diphenyl-N,N-bis(3-methylphenyl)-1,1'-biphenyl-4,4'-diamine.

10. A photoconductor in accordance with claim 1 wherein said charge transport layer is comprised of aryl amine molecules, and which aryl amines are of the formula

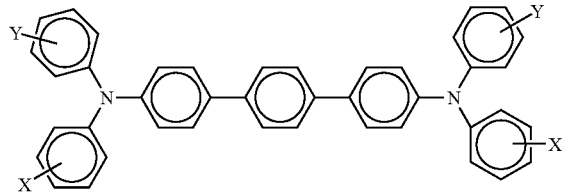

wherein each X and Y is independently selected from the group consisting of alkyl, alkoxy, aryl, and halogen; and mixtures thereof.

11. A photoconductor in accordance with claim 10 wherein each alkoxy and alkyl contains from about 1 to about 10 carbon atoms; aryl contains from about 6 to about 36 carbon atoms; and halogen is chloride, bromide, fluoride, or iodide.

12. A photoconductor in accordance with claim 1 wherein said charge transport layer is comprised of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof.

13. A photoconductor in accordance with claim 1 wherein said at least one charge transport layer contains an antioxidant optionally comprised of a hindered phenol or a hindered amine.

14. A photoconductor in accordance with claim 1 wherein said at least one charge transport layer is from 1 to about 7 layers.

15. A photoconductor in accordance with claim 1 wherein said at least one charge transport layer is from 2 to about 3 layers.

16. A photoconductor in accordance with claim 1 wherein said at least one charge transport layer is comprised of a top charge transport layer and a bottom charge transport layer, and wherein said bottom layer is situated between said photogenerating layer and said top layer.

17. A photoconductor in accordance with claim 1 wherein said photogenerating layer includes a photogenerating pigment comprised of at least one of a metal free phthalocyanine, a metal phthalocyanine, a halogallium phthalocyanine, a perylene, or mixtures thereof.

18. A photoconductor in accordance with claim 1 wherein said photogenerating pigment is comprised of a hydroxygallium phthalocyanine, or a titanyl phthalocyanine, and said substrate is present.

19. A photoconductor in accordance with claim 18 wherein said aminosilane is

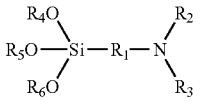

wherein $R_1$ is alkylene, $R_2$ and $R_3$ are independently selected from the group consisting of at least one of hydrogen, alkyl, and aryl, and $R_4$, $R_5$, and $R_6$ are alkyl.

20. A photoconductor in accordance with claim 1 wherein said aminosilane is

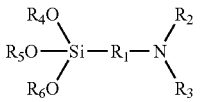

wherein $R_1$ is alkylene; $R_2$ and $R_3$ are independently selected from the group consisting of at least one of hydrogen, alkyl, and aryl, and a poly(ethylene amino) group; and $R_4$, $R_5$, and $R_6$ are alkyl.

21. A photoconductor in accordance with claim 20 wherein said alkylene contains from 1 to about 25 carbon atoms, $R_2$ and $R_3$ alkyl contain from 1 to about 5 carbon atoms, aryl contains from 6 to about 36 carbon atoms, and $R_4$, $R_5$, and $R_6$ alkyl contain from 1 to about 6 carbon atoms.

22. A photoconductor in accordance with claim 20 wherein said alkylene contains from 3 to about 20 carbon atoms, $R_2$ and $R_3$ alkyl contain from 1 to about 3 carbon atoms, aryl contains from 6 to about 18 carbon atoms, and $R_4$, $R_5$, and $R_6$ alkyl contains from 1 to about 4 carbon atoms.

23. A photoconductor in accordance with claim 20 wherein aryl is phenyl, alkyl is methyl, ethyl, propyl, butyl, pentyl, hexyl, heptyl, octyl, or nonyl, and alkylene is ethylene, propylene, butylene, pentylene, or propylene.

24. A photoconductor in accordance with claim 1 wherein said aminosilane is

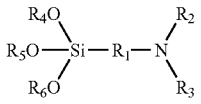

wherein $R_1$ is alkylene, $R_2$ and $R_3$ are independently selected from the group consisting of at least one of hydrogen, alkyl, and aryl, and $R_4$, $R_5$, and $R_6$ are alkyl.

25. A photoconductor in accordance with claim 1 wherein said aminosilane is 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl-3-amino)propyl triethoxysilane, N,N-dimethylaminophenyl triethoxysilane, trimethoxysilylpropyldiethylene triamine, and mixtures thereof.

26. A photoconductor in accordance with claim 1 wherein said aminosilane is at least one of 3-aminopropyl triethoxysilane, and N-aminoethyl-3-aminopropyl trimethoxysilane.

27. A photoconductor in accordance with claim 1 wherein said aminosilane is 3-aminopropyl triethoxysilane, N,N-dimethyl-3-aminopropyl triethoxysilane, N-phenylaminopropyl trimethoxysilane, triethoxysilyipropylethylene diamine, trimethoxysilyipropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'dimethyl-3-amino)propyl triethoxysilane, N,N-dimethylaminophenyl triethoxysilane, or trimethoxysilylpropyldiethylene triamine.

28. A photoconductor in accordance with claim 1 wherein said substantially insoluble for said resin binder is from about 92 to about 100 percent.

* * * * *